US006857706B2

(12) United States Patent
Hames et al.

(10) Patent No.: US 6,857,706 B2
(45) Date of Patent: Feb. 22, 2005

(54) MINING METHOD FOR STEEPLY DIPPING ORE BODIES

(75) Inventors: Marilyn Patricia Ann Hames, Vancouver (CA); Timothy B. Dimock, Timmins (CA); Edward William Drew Anwyll, Gauteng (ZA); Donald Duncan Young, Sudbury (CA); Fredric Christopher Delabbio, Sudbury (CA); Eric Jackson, New Westminster (CA); Simon Mark Jackson, Vancouver (CA)

(73) Assignee: Placer Dome Technical Services Limited, Vancouver (CA)

( * ) Notice: Subject to any disclaimer, the term of this patent is extended or adjusted under 35 U.S.C. 154(b) by 0 days.

(21) Appl. No.: 10/309,237

(22) Filed: Dec. 4, 2002

(65) Prior Publication Data

US 2003/0173819 A1 Sep. 18, 2003

Related U.S. Application Data

(60) Provisional application No. 60/339,454, filed on Dec. 10, 2001, and provisional application No. 60/418,716, filed on Oct. 15, 2002.

(51) Int. Cl.[7] ..... E21C 41/16; E21C 25/06

(52) U.S. Cl. ..... 299/18; 299/19; 299/95; 299/63; 299/1.1

(58) Field of Search ..... 299/18, 19, 1.1, 299/1.2, 1.6, 1.8, 29, 36.1, 42, 95, 34.01, 63

(56) References Cited

U.S. PATENT DOCUMENTS

| | | | |
|---|---|---|---|
| 1,211,679 A | 1/1917 | Constantinesco | |
| 1,566,460 A | 12/1925 | Wyman | |
| 3,309,145 A | 3/1967 | Arentzen | 299/71 |

(List continued on next page.)

FOREIGN PATENT DOCUMENTS

| | | | |
|---|---|---|---|
| AU | B-56857/80 | 3/1980 | E21C/27/24 |
| AU | B-56858/80 | 3/1980 | E21C/27/24 |
| AU | B-71066/81 | 5/1981 | E21C/27/01 |
| AU | B-66910/81 | 8/1981 | E21C/27/24 |
| AU | B-17369/83 | 7/1983 | E21C/27/24 |

(List continued on next page.)

OTHER PUBLICATIONS

Application Notes, Hi–Vac, 12 pages, undated.
New–Vac Mining Brochure, 9 pages, undated.
Sixth International Symposium on Mine Mechanization and Automation, The South Africa Institute of Mining and Metallurgy, Johannesburg 2000, 284 pages.
"McArthur River Uranium," *Mining Magazine* (Oct. 1997), available at http://www.wma–minelife.com/uranium/mining/art138.htm.
AGH Associates, "Reef Miner Projects," http://www.reefminer.com/, Sep. 24, 2001, pp. 2.
AGH Associates, "Reef Miner Questions," http://www.reefminer.com/page3.html.
AGH Associates, "Reef Miner Description," http:/www.reefminer.com/page2.html.
Brochure entitled "BAUER Trench Cutter Systems".
Slide show entitled "Horizontal Cutter Mining, Mining of Layers of Platinum Group of Minerals (PGM) with BAUER Trench Cutter Technology.".

*Primary Examiner*—John Kreck
(74) *Attorney, Agent, or Firm*—Sheridan Ross P.C.

(57) ABSTRACT

The present invention is directed to a mining method for steeply dipping orebodies. In the method, an excavator 152 is tethered to a deployment system 120 by one or more cables/umbilicals 144. The excavator 152 excavates slices 172*a–h* of the orebody 100 by moving generally up-dip, down-dip or a combination thereof. The excavator can be automated.

39 Claims, 11 Drawing Sheets

U.S. PATENT DOCUMENTS 3,341,254 A 9/1967 Arndt ..... 299/18
3,371,964 A * 3/1968 Weber ..... 299/1.1
3,477,762 A 11/1969 Frenyo et al. ..... 299/10
3,544,075 A 12/1970 Sugden ..... 259/1
3,581,500 A 6/1971 Sugden ..... 60/54.5 R
3,584,918 A 6/1971 Gaglione et al. ..... 299/31
3,596,724 A 8/1971 Bechem ..... 175/331
3,598,445 A 8/1971 Winberg ..... 299/31
3,620,573 A * 11/1971 Oxfiord et al. ..... 299/35
3,647,263 A * 3/1972 Lauber et al. ..... 299/31
3,663,054 A 5/1972 Dubois ..... 299/18
3,695,717 A 10/1972 Birrer ..... 299/31
3,719,394 A * 3/1973 Hartley ..... 299/1.1
3,776,592 A 12/1973 Ewing ..... 299/1
3,784,257 A 1/1974 Lauber et al. ..... 299/31
3,788,703 A 1/1974 Thorpe ..... 299/14
3,840,270 A 10/1974 Allgood ..... 299/14
3,847,584 A 11/1974 Houser et al. ..... 65/40
3,860,292 A 1/1975 Bechem ..... 299/86
3,861,748 A 1/1975 Cass ..... 299/10
3,904,244 A * 9/1975 Haspert ..... 299/34.04
3,907,366 A 9/1975 Pender ..... 299/18
3,957,310 A 5/1976 Winberg et al. ..... 299/31
3,963,080 A 6/1976 Walker ..... 175/94
4,045,088 A 8/1977 Bechem ..... 299/31
4,123,109 A * 10/1978 Hill ..... 299/18
4,159,852 A 7/1979 Montgomery ..... 299/56
4,176,884 A * 12/1979 Erwien et al. ..... 299/34.08
4,189,186 A 2/1980 Snyder ..... 299/31
4,213,653 A * 7/1980 Grenia ..... 299/11
4,284,368 A 8/1981 Albright ..... 405/291
4,312,541 A 1/1982 Spurgeon ..... 299/31
4,323,280 A 4/1982 Lansberry ..... 299/1
4,330,155 A * 5/1982 Richardson et al. ..... 299/11
4,375,594 A 3/1983 Ewanizky, Jr. ..... 307/110
4,391,469 A * 7/1983 Arsuaga ..... 299/11
4,523,651 A * 6/1985 Coon et al. ..... 175/45
4,527,837 A 7/1985 Snyder ..... 299/31
4,541,848 A 9/1985 Masuda ..... 55/139
4,568,127 A 2/1986 Traumüller et al. ..... 299/81
4,572,583 A 2/1986 Traumümiller et al. ..... 299/81
4,578,627 A 3/1986 Dröscher et al. ..... 318/632
4,591,209 A 5/1986 Dröscher et al. ..... 299/1
4,603,910 A * 8/1986 Laneus ..... 299/13
4,637,657 A 1/1987 Snyder ..... 299/31
4,641,889 A 2/1987 Brandl ..... 299/75
4,643,567 A 2/1987 Dröscher et al. ..... 356/152
4,662,685 A 5/1987 Bärnthaler et al. ..... 299/33
4,664,449 A 5/1987 Bärnthaler et al. ..... 299/74
4,669,785 A 6/1987 Brandl ..... 299/68
4,688,855 A 8/1987 Bärnthaler et al. ..... 299/75
4,696,518 A 9/1987 Zitz et al. ..... 299/75
4,711,502 A 12/1987 Bärnthaler et al. ..... 299/33
4,729,445 A 3/1988 Kolleth ..... 180/9.46
4,735,458 A 4/1988 Wrulich et al. ..... 299/81
4,736,987 A 4/1988 Lenzen et al. ..... 299/86
4,741,405 A 5/1988 Moeny ..... 175/16
4,744,431 A 5/1988 Stöllinger ..... 180/9.5
4,753,484 A 6/1988 Stolarczyk ..... 299/1
4,758,049 A 7/1988 Wernigg et al. ..... 299/33
4,770,469 A 9/1988 Schellenberg et al. ..... 299/1
4,784,439 A 11/1988 Wrulich et al. ..... 299/57
4,786,112 A 11/1988 Brandl ..... 299/76
4,796,713 A 1/1989 Bechem et al. ..... 175/96
4,805,963 A 2/1989 Kogler et al. ..... 299/33
4,815,543 A 3/1989 Lenzen et al. ..... 175/350
4,834,197 A 5/1989 Bauer et al. ..... 175/91
4,875,738 A 10/1989 Zitz et al. ..... 299/80
4,878,714 A 11/1989 Bärnthaler et al. ..... 299/67
4,884,847 A 12/1989 Bessinger et al. ..... 299/1
4,921,307 A * 5/1990 Braun et al. ..... 299/34.07
4,921,309 A 5/1990 Harrison ..... 299/75
4,957,606 A 9/1990 Juvan ..... 204/164
4,958,696 A 9/1990 Lerchbaum ..... 180/6.7
4,966,417 A 10/1990 Zitz et al. ..... 299/33
5,007,683 A 4/1991 Granskog ..... 299/10
5,050,934 A 9/1991 Brandl et al. ..... 299/33
5,072,994 A 12/1991 Brandl et al. ..... 299/67
5,098,166 A 3/1992 Ebner et al. ..... 299/81
5,103,705 A 4/1992 Bechem ..... 83/491
5,108,154 A 4/1992 Brandl et al. ..... 299/76
5,121,971 A 6/1992 Stolarczyk ..... 299/1.6
5,161,857 A 11/1992 Mayercheck ..... 299/30
5,178,494 A 1/1993 Zitz et al. ..... 405/290
5,181,934 A 1/1993 Stolarczyk ..... 299/1.2
5,190,353 A 3/1993 Bechem ..... 299/86
5,228,552 A 7/1993 Brandl et al. ..... 198/515
5,268,683 A 12/1993 Stolarczyk ..... 340/854.4
5,333,936 A 8/1994 Zitz ..... 299/64
5,340,199 A 8/1994 Piefenbrink et al. ..... 299/10
5,368,369 A 11/1994 Maity et al. ..... 299/11
5,438,517 A 8/1995 Sennott et al. ..... 364/449
5,439,274 A 8/1995 Krueckl ..... 299/59
5,513,903 A 5/1996 Mraz ..... 299/18
5,557,979 A 9/1996 Krassnitzer et al. ..... 74/377
5,582,467 A 12/1996 Drolet et al. ..... 299/33
5,685,615 A 11/1997 Bechem et al. ..... 299/110
5,752,572 A 5/1998 Baiden et al. ..... 175/26
5,810,447 A 9/1998 Christopher et al. ..... 299/30
5,896,938 A 4/1999 Moeny et al. ..... 175/1
5,939,986 A 8/1999 Schiffbauer et al. ..... 340/573.1
5,964,305 A 10/1999 Arzberger et al. ..... 175/91
5,992,941 A 11/1999 Delli-Gatti, Jr. ..... 299/64
5,999,865 A 12/1999 Bloomquist et al. ..... 701/25
6,027,175 A 2/2000 Seear et al. ..... 299/18
6,058,029 A 5/2000 Itow et al. ..... 363/59
6,109,699 A 8/2000 Mraz ..... 299/10
6,139,477 A 10/2000 Bechem et al. ..... 483/1
6,164,388 A 12/2000 Martunovich et al. ..... 175/1
6,206,478 B1 3/2001 Uehara et al. ..... 299/33
6,215,734 B1 4/2001 Moeny et al. ..... 367/147
6,224,164 B1 5/2001 Hall et al. ..... 299/75
6,244,664 B1 6/2001 Ebner et al. ..... 299/80.1
6,257,671 B1 7/2001 Siebenhofer et al. ..... 299/1.6
6,308,787 B1 10/2001 Alft ..... 175/48
6,315,062 B1 11/2001 Alft et al. ..... 175/45
6,431,653 B1 8/2002 Kleuters ..... 299/31
6,505,892 B1 1/2003 Walker et al. ..... 299/32
2001/0015573 A1 8/2001 Mraz ..... 299/10
2002/0074849 A1 6/2002 Paschedag et al. ..... 299/13
2002/0096934 A1 7/2002 Seear et al. ..... 299/18

FOREIGN PATENT DOCUMENTS

AU B-36721/84 11/1984 ..... E21D/9/08
AU B-37937/85 1/1985 ..... E21C/27/24
AU B-45200/85 7/1985 ..... E21C/27/24
AU B-45843/85 8/1985 ..... E21C/27/24
AU A-55091/86 3/1986 ..... E21C/27/30
AU A-62506/86 9/1986 ..... E21C/27/24
AU B-12696/88 3/1988 ..... E21D/9/10
AU B-74104/94 9/1994 ..... E21C/35/06
CA 1 214 797 12/1986 ..... E21C/25/16
CA 1 218 388 2/1987 ..... E21C/27/24
CA 1 262 368 10/1989 ..... E21C/27/24
CA 2109921 5/1992 ..... E21D/9/10
CA 2121044 9/1992 ..... E21C/29/00
CA 2291043 5/1998 ..... E21D/9/10
EP 115 942 A2 1/1984
EP 115 942 B1 5/1990 ..... E21D/9/10
GB 735749 8/1953
GB 2 120 579 A 12/1983 ..... B02C/19/18

| | | | | |
|---|---|---|---|---|
| JP | 59192195 A2 | 10/1984 | ..... | E21D/9/10 |
| WO | WO 84/02951 | 8/1984 | ..... | E21D/9/08 |
| WO | WO 85/02653 | 6/1985 | ..... | E21C/41/00 |
| WO | WO 97/48883 | 12/1997 | ..... | E21C/29/24 |
| WO | WO 98/35133 | 8/1998 | ..... | E21C/27/24 |
| WO | PCT/AU00/00030 | 7/2000 | ..... | E21D/9/10 |
| WO | PCT/AU00/00066 | 8/2000 | ..... | E21C/25/16 |
| ZA | 82/1297 | 2/1982 | | |
| ZA | 83/3060 | 4/1983 | | |
| ZA | 84/9431 | 12/1984 | | |
| ZA | 92/3454 | 5/1992 | | |
| ZA | 92/3455 | 5/1992 | | |
| ZA | 94/4480 | 6/1994 | | |
| ZA | 97/4804 | 12/1997 | | |
| ZA | 98/8239 | 9/1998 | | |
| ZA | 99/2714 | 10/1999 | | |
| ZA | 2000/7587 | 12/2000 | | |
| ZA | 99/7873 | 3/2001 | | |
| ZA | 2002/6394 | 8/2002 | | |

* cited by examiner

MINING METHOD FOR STEEPLY DIPPING ORE BODIES

CROSS REFERENCE TO RELATED APPLICATIONS

This application is related to U.S. Provisional Patent Application Ser. Nos. 60/339,454 filed Dec. 10, 2001, and 60/418,716, filed Oct. 15, 2002, each of which is incorporated herein by this reference.

FIELD OF THE INVENTION

The present invention relates generally to mining valuable mineral and/or metal deposits and specifically to mining steeply dipping valuable mineral and/or metal deposits.

BACKGROUND OF THE INVENTION

Considerable amounts of valuable metals are contained in steeply dipping ore bodies, particularly narrow vein deposits. Such ore bodies typically have a dip of about 35° or more and more typically of about 45° or more, have thicknesses from several inches to several few feet, and are normally in hard or high strength rock at shallower depths and in very hard or very high strength rock at deeper depths.

Several methods have been employed to mine such deposits.

For example, in long-hole mining long holes are drilled into the ore body, the material is blasted, and the broken material flows by gravity down the pitch or dip of the ore body to a loading or draw point. This method suffers from high capital costs in that considerable underground excavations in the form of chambers and crosscuts must be in place before long-holing can commence. Such underground excavations must be in place for each level before the ore body portion located above that level can be mined.

In yet another method known as block caving, material is mined from the bottom of a "block" of ore. The overlying portion of the block progressively caves as the mined/previously caved material is drawn off from the bottom of the block. Like the long-hole mining method, the block caving method suffers from high capital costs due to the need for extensive excavations before caving can commence. Additionally, the method is limited to proper combinations of ore and adjacent country rock characteristics and it is often difficult to control the rate of draw to prevent losing large amounts of ore, thereby causing a low recovery.

In yet another method known as stoping, an elongated excavation extending longitudinally along the strike of the ore body (known as the stope) is driven upwardly or downwardly following the deposit. To provide support for the hanging wall, pillars can be left in place and/or backfilling (using mine tailings, concrete, etc.) can be performed. This method is typically capital and labor intensive and therefore suffers from a high mining cost per ton of ore mined.

All of the above methods have a number of common drawbacks. The methods typically have extreme difficulty controlling the effects of dilution. Dilution occurs where the valuable mineral or metal-containing rock is mixed with surrounding barren or country rock. The methods are generally uneconomical in narrow vein-type deposits. Narrow vein-type deposits have thicknesses in the order of 1 to 5 feet. The methods can lead to unsafe conditions for mining personnel. Whenever personnel are required to work in areas that are constantly changing, such as in stopes, there is a danger of an unplanned ground failure. As mining continues to reach greater depths, there are inherent increases in the principal stresses. These stresses can exceed the rock strength, resulting in potentially dangerous rock bursts. As noted, the methods further suffer from high capital and/or operating costs. As will be appreciated, the size of a mine's reserves is a direct function of the costs to extract and process the ore reserves. When the mine site costs are reduced, the economic cut off grade for the mineralization is also reduced so that additional mining reserves become profitable to be mined.

SUMMARY OF THE INVENTION

These and other needs are addressed by the various embodiments and configurations of the present invention. The present invention provides a mining method and system that is capable of efficiently and effectively mining steeply dipping orebodies.

In one embodiment, a method for mining a valuable material in a steeply dipping deposit is provided. The method includes the steps of:

(a) providing a deposit of a material to be excavated, the deposit having a dip of at least about 35° and a number of intersecting excavations;

(b) removing a first segment of the block, the first segment extending substantially or fully the length of a side of the block and being adjacent to and accessible by an excavation; and (c) thereafter removing a second segment of the block, the second segment extending substantially or fully the length of the side of the block and being adjacent to the first segment before the removing step (b). The intersecting excavations typically include spaced apart first and second excavations, e.g., tunnels, headings, etc., extending generally in a direction of a strike of the deposit and a third excavation, e.g., shaft, stope, etc., intersecting the first and second excavations and extending generally in a direction of the dip of the deposit. The first and second segments generally extend in the direction of the dip of the deposit. As used herein, the "strike" of a deposit is the bearing of a horizontal line on the surface of the deposit, and the "dip" is the direction and angle of a deposits inclination, measured from a horizontal plane, perpendicular to the strike. A number of excavations extending generally in the direction of the strike can be used in connection with one or more excavations extending generally in the direction of the dip to divide the orebody in a number of minable blocks.

The mining method can be fully or partially automated. For example, the excavation system can include control, sensor, navigation, and maneuvering subsystems. The various components can be distributed among a number of locations. For example, part of the control subsystem can be located in the vicinity of the excavator while another part of the control subsystem (where the operator(s) is/are located) is located at a surface or remote underground location. Automation permits an operator or group of operators to control simultaneously and remotely a number of excavation systems.

The system and method of the present invention can provide a number of advantages. First, the method provides an efficient and cost effective way to excavate steeply dipping orebodies, particularly steeply dipping orebodies of narrow widths. The method can mine the material in the orebodies with dilution levels far lower than those possible with current mining methods and techniques. A conventional narrow vein stope must be of a size that allows access for people and mining equipment, which typically requires the stope to be excavated to a size greater than the width of the mineralized vein causing dilution. The system and method of the present invention, in contrast, can use a narrower stope width as the excavation is typically done remotely by operating personnel.

Second compared to conventional stopes, the remote operation of the excavation assembly can also reduce significantly the danger to personnel caused by unstable ground, and the reduced sizes of voids in and about the stope can also beneficially reduce the likelihood of a seismic event as the impact on the regional void/rock ratio is significantly reduced. Unlike conventional stopes, personnel generally do not have to enter the stope, except in the event of operational problems and/or maintenance of the excavator system. This is particularly advantageous for steeply dipping deposits located at great depths.

Third, the reduced dilution and improved automation can reduce the mine's costs significantly. On the mining side, dilution and improved automation can reduce excavation costs by minimizing materials handling, reducing manpower, reducing equipment requirements, reducing ground support, reducing primary ventilation capacities, and permitting improved utilization of people and equipment. On the processing side, the reduced tonnage required for a given amount of metal production can have huge benefits for the milling process. Cost savings due to the reduced system capacities can apply in comminution, flotation, tailings disposal, plant manpower, electricity, diesel, and improved utilization of people in the plant. The reduced operating costs compared to conventional mining methods can increase the size of a mine's reserves (which is directly dependent on the costs to extract and process the mineralized material).

Fourth, the method and system of the present invention can be highly flexible. The method and system can follow and track narrow vein ore regardless of the orientation, dip, or metal being mined. The on board sensors and navigation system can provide precise tracking in most applications.

Fifth, compared to the above prior art techniques the method and system can require less underground development before the orebody is mined by the technique of the present invention.

Sixth, the method of the present invention is typically not limited to proper combinations of ore and adjacent country rock characteristics for the method to be able to mine an orebody.

Seventh, the method of the present invention does not generally require a draw rate to be controlled to prevent losing large amounts of ore.

Other advantages will be evident to one of ordinary skill in the art based on the descriptions of the inventions set forth below.

The above-described embodiments and configurations are neither complete nor exhaustive. As will be appreciated, other embodiments of the invention are possible utilizing, alone or in combination, one or more of the features set forth above or described in detail below.

DETAILED DESCRIPTION

Overview of the Mining Method

Figure 1:
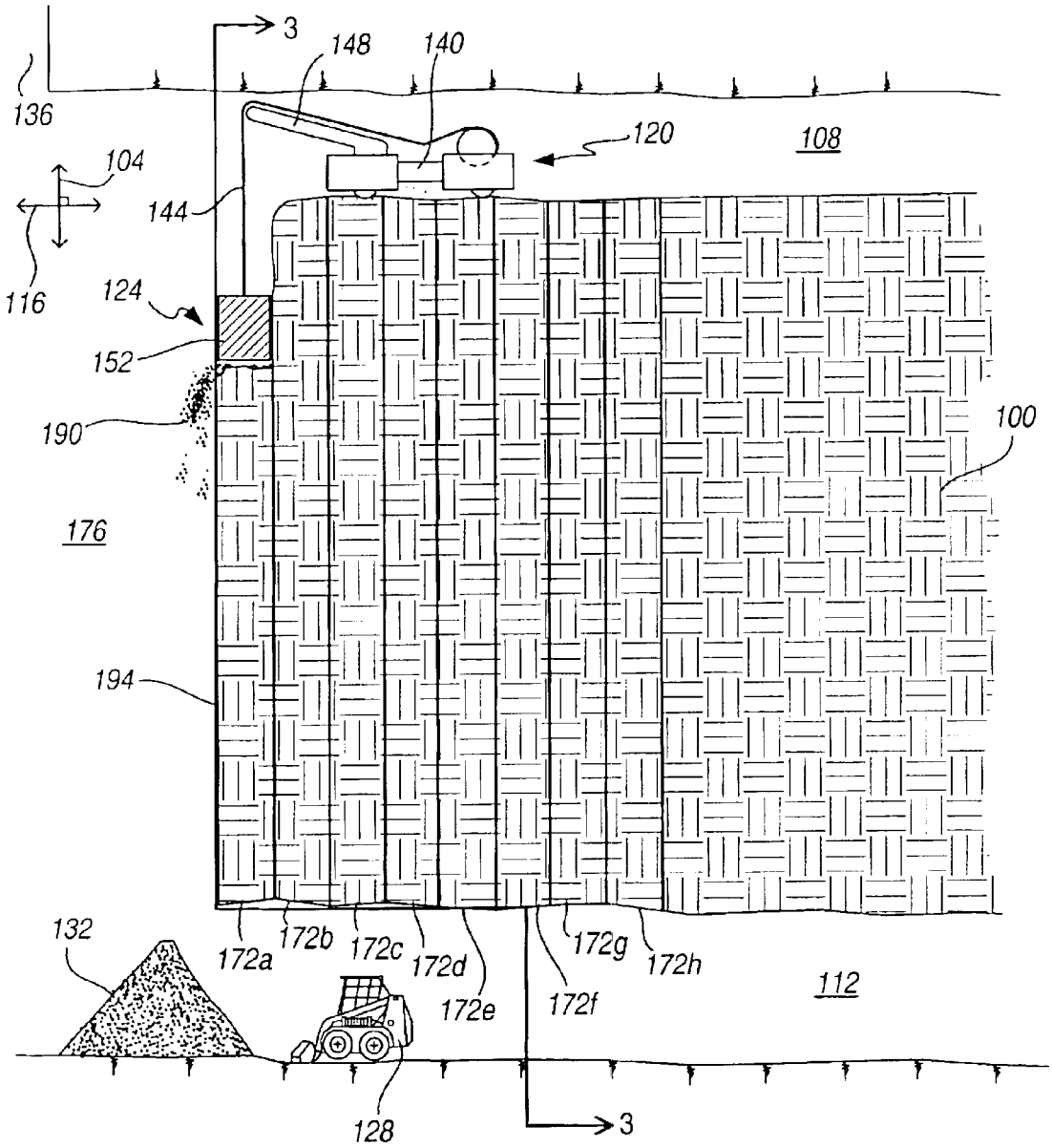
FIG. 1 is a side view of an embodiment of a mining method according to the present invention.
Figure 2:
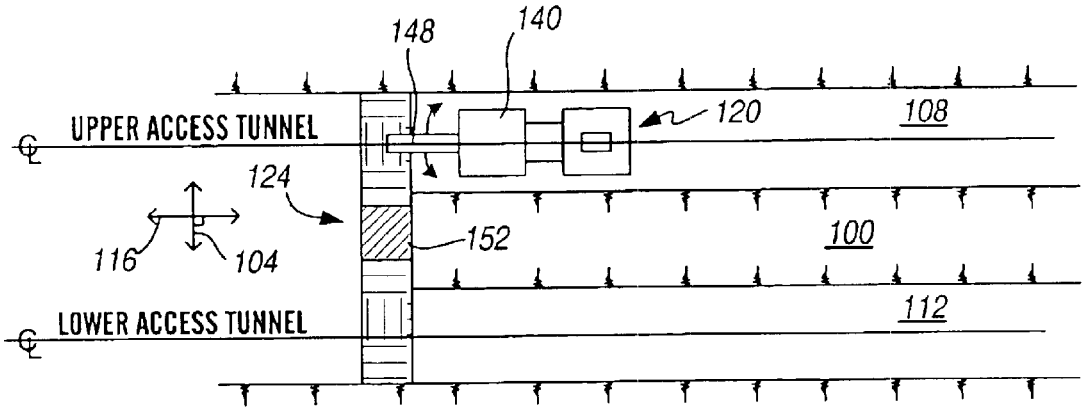
FIG. 2 is a plan view of the embodiment of the mining method of FIG. 1 along line 2—2 of FIG. 3.
Figure 3:
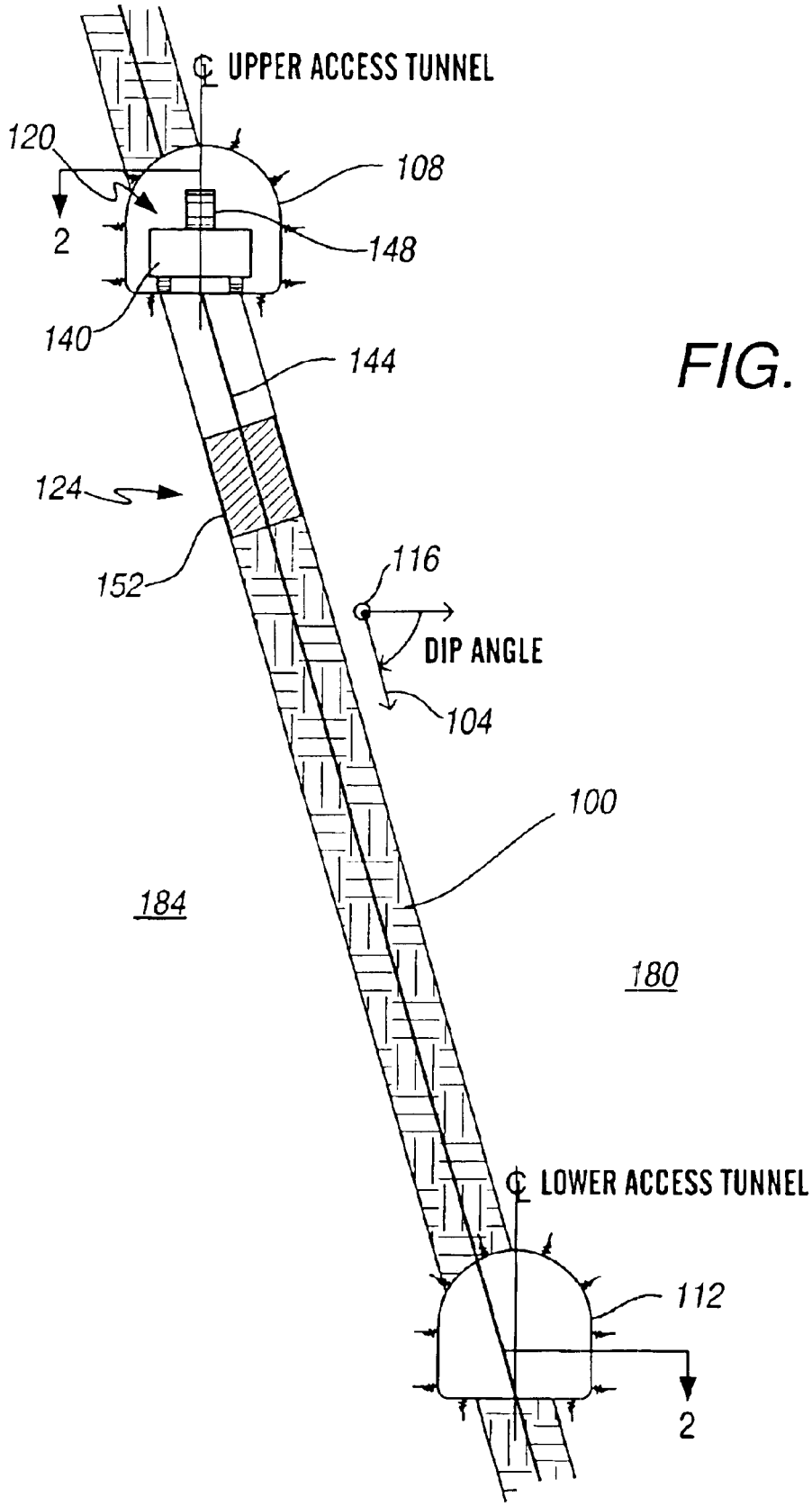
FIG. 3 is a side view of the embodiment of the mining method of FIG. 1 along line 3—3 of FIG. 1.

FIGS. 1–3 depict a mining method according to a first embodiment of the present invention for mining orebody 100. Orebody 100 can be any valuable mineral-containing deposit, whether of igneous, metamorphic, or sedimentary origin, whether the valuable minerals are metalliferous, industrial or nonmetallic, coal, or mineral fuel, and of any shape. Orebody 100 typically is planar in shape and has a dip 104 greater than an angle of repose of the excavated material and typically ranging from 35° to about 90°.

The mine plan for the (down-dip) mining method includes first and second tunnels 108 and 112 located at different depths (or levels) and passing through at least portions of the orebody 100. Each tunnel 108 and 112 has a heading that is generally parallel to the strike 116 of the orebody 100. The first tunnel 108 provides access for deployment system 120 to raise and lower the excavation system 124 and provide various utilities and telemetry to the excavation system 124. The second tunnel 112 provides access for haulage equipment, such as loader 128, to load and haul the mined material 132 to a desired location. As will be appreciated, haulage equipment can also be a scraper, a (scraper) conveyor, a mini-scoop, tracked or rubber-tired haulage vehicles (e.g., trucks, shuttle cars, and tractor trailers), water jets, rail cars, a haulage pipeline (e.g., a hydraulic hoist), and combinations thereof. As will be appreciated, other tunnels can be located at the same, shallower or deeper depths to delineate or divide the orebody into a plurality of blocks such as the block shown in FIG. 1.

A shaft 136 passes through at least a portion of the orebody 100. The heading of the shaft 136 is generally transverse (and sometimes normal) to the headings of the tunnels 108, 112 and can have shaft sections having headings parallel to the dip 104. The shaft 135 permits access to the tunnels and removal of mined material. As will be appreciated, all or part of the shaft can be replaced by another suitable ingress/egress excavation, such as an incline, decline, drift, tunnel, borehole, and raise.

The deployment system 120 is positioned in the first tunnel 108 and tethers the excavation system 124. The deployment system 120 includes a mobile hoist 140 and support cables and umbilicals 144. In one configuration, the cable(s) suspend and control positioning of the excavation system 124 while the umbilical line(s) provide to the excavation system 124 one or more of (flushing) water, electric power, telemetry, communication links, hydraulic fluid, and pneumatics. The deployment system 120 can use any suitable carriage for the hoist 140 and any suitable boom components for the boom 148. In one configuration the boom 148 can swing or move side-to-side as shown in FIG. 2 to facilitate movement of the excavation system 124. In another configuration, the carriage of the deployment system 120 is also articulated to permit such movement.

As will be appreciated, the cables and umbilical line(s) can be combined into a single umbilical line having strengthening members. Additionally, it is to be understood that the excavator can include features, such as hydraulically actuated pads or feet, to support and maneuver itself during excavation. In this configuration, the cables would provide support only in the event that the excavator was unable to maneuver itself or lost its grip against the opposing hanging wall and foot wall of the excavation.

Types of Excavators

The excavator 152 progressively removes slices 172 of the orebody 100 to form stope 176 between the hanging and footwalls. The excavator 152 can be any suitable batch, semicontinuous or continuous excavation system for excavating the material in the orebody. The excavator 152 is preferably continuous and should be selected based on mining factors such as rock stress, ore orientation, rock quality, ore access, materials handling systems and the like. Examples of suitable excavators include disc cutters, plasma hydraulic excavators, drill and/or blasting techniques (whether using small or large charges), hammers, and water jets. Several of these excavators are discussed in more detail below.

Roller and Disc Cutters

Figure 5:
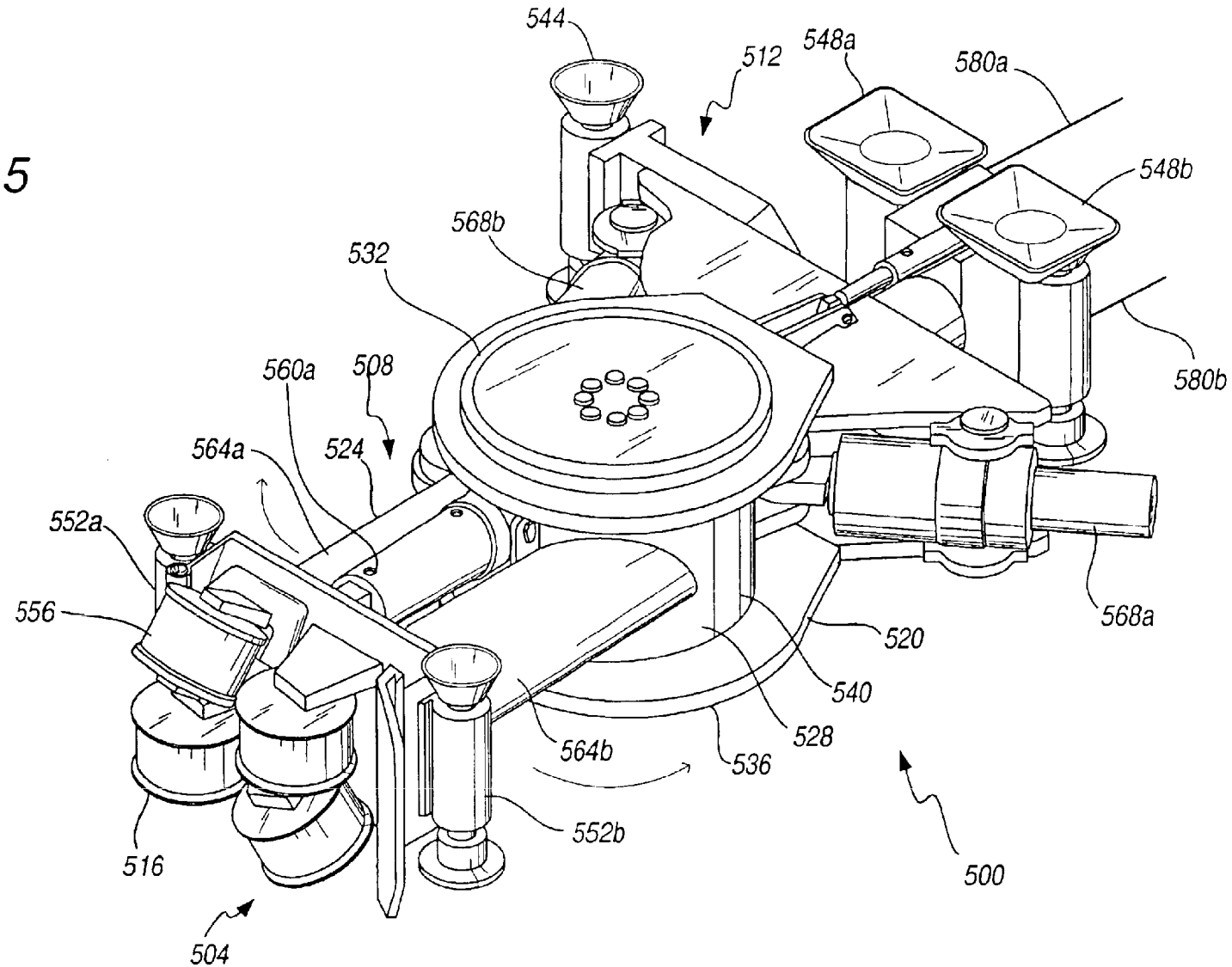
FIG. 5 is a perspective view of an excavator according to a first configuration.
Figure 6:
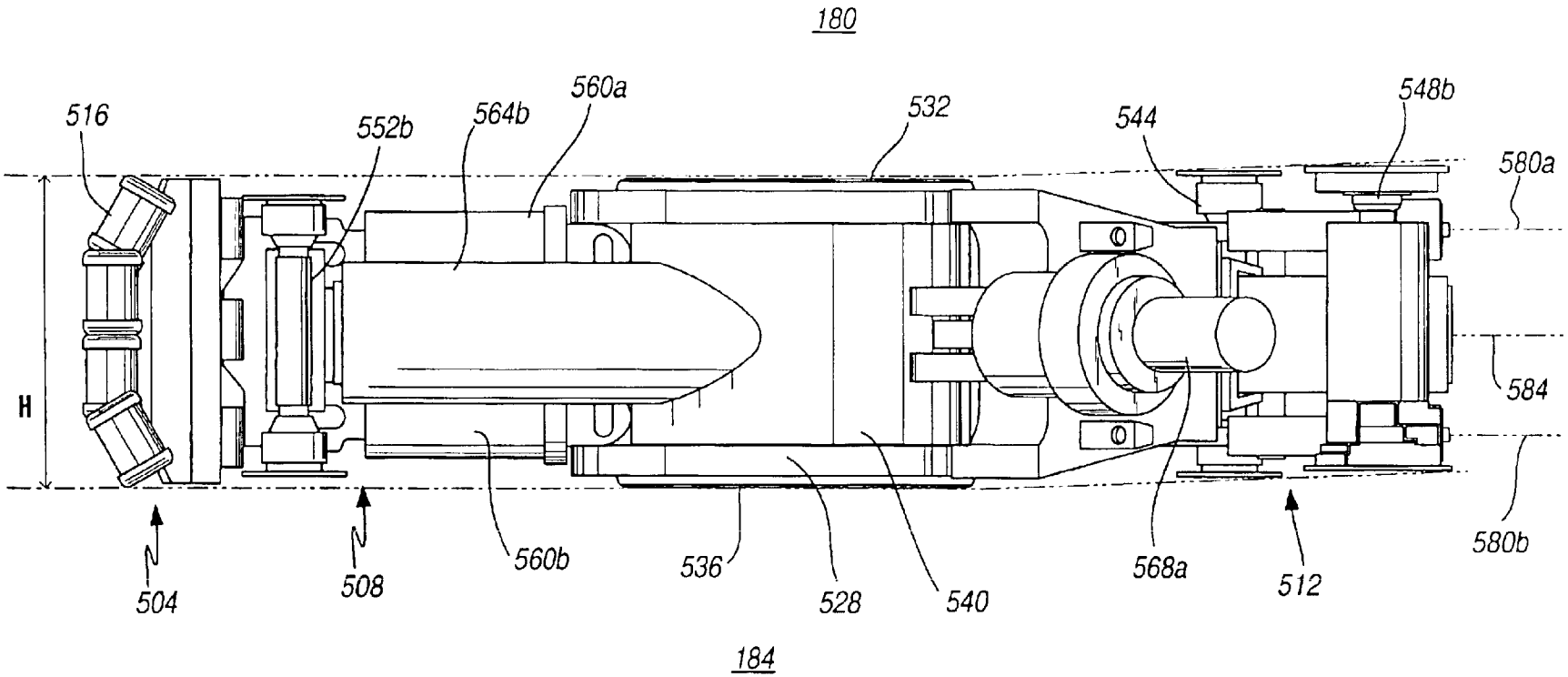
FIG. 6 is a side view of the excavator of FIG. 5.

FIGS. 5–6 depict a first configuration of a disc cutter-type excavator. The cutter 500 includes a cutter head 504 mounted on a swinging boom structure 508 and a body 512. The cutter head 504 mounts a plurality of overlapping cutting discs or rollers 516, such as rolling type kerf cutters, carbide cutters, button cutters, and disc cutters. The rear end 520 of the boom 524 is rotatable about the anchorable body 512. The rotational axis is formed by a vertically (or horizontally) arranged hydraulic actuator 528 with its axis at right angles to the length of the boom 524. Actuator 528 has a hanging wall engaging head 532 and a footwall engaging foot 536. The boom 524 is mounted on the cylinder 540 of the actuator 528. Additional actuators 544 and 548*a,b* are located in the body to provide additional anchor supports and to facilitate movement/maneuvering of the cutter 500 (as discussed below). Further vertical (or horizontal) actuators 552*a,b* are provided at the front end 556 of the boom 524 to permit the boom 524 to be anchored between the hanging and footwalls 180, 184 (FIG. 3). Each of the actuators 544, 548*a,b*, and 552*a,b* has a hanging wall engaging head and a footwall engaging foot. Actuators 528, 544, 548*a,b* and 552*a,b* collectively form part of the maneuvering subsystem. Boom 524 includes advancing hydraulic actuator 564*a,b* extend the cutter head 504 relative to the body 512 and thereby force the discs or rollers 516 against the rock face. Hydraulic cylinders 564*a,b* also provide rigidity to the cutter head 504 during excavation to resist torsional forces exerted on the cutter head 504/body 512 interface. Finally, swing actuators 568*a,b* cause rotation of the boom 504 relative to the body 512 (as shown) by extending and retracting in opposing cycles. That is, when swing actuator 568*a* extends, swing actuator 568*b* retracts and vice versa.

The cutter 500 typically excavates rock by breaking rock in compression during boom rotation or swings. The discs or rollers work by applying high point loads to the rock and crushing a channel through the rock. The pressure exerted by the discs or rollers in turn breaks small wedges of rock away from the edge of the discs or rollers, thereby excavating the rock. The array of discs or rollers 516 in the head 504 will sweep (or cycle) across the face excavating in the order of about 2 mm of the rock face per rotational cycle.

The cutter 500 maneuvers itself by using the various actuators (or hydraulic rams). For example, when the advancing hydraulic cylinder 564 is extended to a desired degree, the cutter 500 must be moved forward to excavate more rock. This is done by aligning the boom and body centerlines and releasing (or extracting or disengaging) hanging wall engaging heads and footwall engaging feet of actuators 532, 544 and 548*a,b* from the hanging and footwall, respectively, while engaging (or extending) hanging wall engaging heads and footwall engaging feet of actuators 552*a,b* with the hanging wall and footwall, respectively. Advancing hydraulic cylinder 564 is then retracted causing the body 512 to move forward while the cutter head 504 remains stationary. When the body 512 is moved forward as desired, hanging wall engaging heads and footwall engaging feet of actuators 532, 544 and 548*a,b* are re-engaged (or extended) with the hanging wall and footwall, respectively, while hanging wall engaging heads and footwall engaging feet of actuators 552*a,b* are released (or extracted or disengaged) from the hanging wall and footwall, respectively. The cycle is then repeated until the advancing ram is extended to the desired degree and the steps are then repeated.

The cutter 500 can turn by aligning the boom and body centerlines, extending actuators 552*a,b* while retracting activators 532, 544, and 548*a,b*, and rotating the body around actuator 532 by actuating swing actuators 568*a,b*. After retracting actuators 552*a,b* and extending actuators 532, 544, and 548*a,b*, excavation is resumed in a new direction. Alternatively, the cutter 500 can turn by rotating the boom 524 relative to the body 512 before the above sequence is initiated. Alternatively, directional control can be achieved by differential loading of the various actuators during the foregoing sequence of steps.

The boom can be steered vertically to raise or lower the cutter head 504 by swinging the boom to one side, retracting (or reducing the force applied by) actuator 528, and extending/retracting the actuators 544, and/or 548*a,b* to raise or lower the body to place the cutter head at a desired height.

The cutter 500 will typically have one or more umbilicals 584, one of which provides water to flush cuttings from the face, to control dust, and control heat buildup during excavation, another of which provides electric power, another of which provides hydraulic fluid, and/or yet another of which provides signal transmission or telemetry (for navigation, steering, video, operating level measurements, etc.). A plurality of support cables 580*a,b* and are attached to the body 512 to suspend the cutter 500 as needed.

The cutter 500 height "H" (FIG. 6) can be selected to be no more than the thickness of the orebody 100. In some applications, the height is much less than the orebody thickness, thereby requiring several sweeps across the face to produce a cut having the desired height.

The cutter 500 is described in more detail in U.S. Provisional Application entitled "Continuous Vein Mining System", Ser. No. 60/410,048, to Gibbons et al., filed Oct. 15, 2002, which is incorporated herein by this reference.

Undercut Disc Cutter

Figure 7:
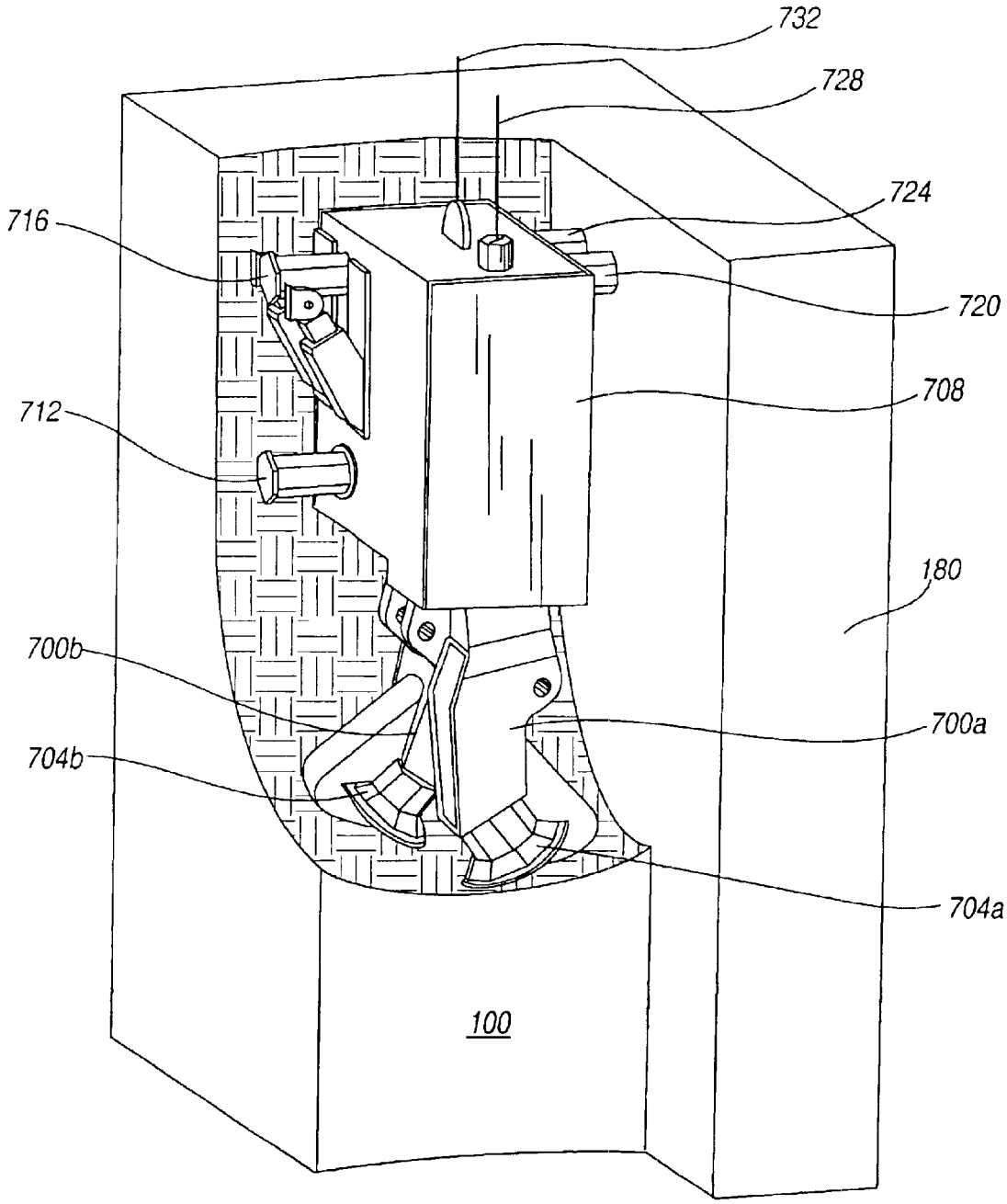
FIG. 7 is a perspective view of an excavator according to a second configuration.

An undercut disc cutter can also be employed as the excavator. An undercut disc cutter breaks rock in tension, using discs to undermine and "rip" rock from the face. The undercut disc cutter can use a carrier similar to that depicted in FIGS. 5–6. Alternatively, the undercut disc cutter can use the carrier depicted in FIG. 7. The carrier includes a plurality of booms 700*a,b* mounting undercut disc cutters 704*a,b* mounted on a body 708. The booms and disc cutters typically move in three dimensions to excavate the face. The booms can be hydraulically extendible to permit the cutter to excavate an increased depth of rock from a single location. A plurality of actuators 712, 716, 720, and 724 are used to engage the hanging and footwalls and thereby anchor the body in place. To advance the disc cutters for the next cycle, the actuators are retracted (or disengaged with the hanging and footwalls) and cables 728 and 732 lowered until the cutter is in the desired position.

Vibrating Undercutting Disc Cutter

A vibrating undercutting disc cutter can also be employed as the excavator 152 (FIGS. 1–3). The vibrating undercutting disc cutter operates by slicing a relatively large vibrating disc under and across the face. The slicing action removes relatively small pieces of rock from the face using tensile forces which are far lower than those typically required by compressive disc cutters. The carrier for the disc cutter can be similar to that described above with reference to FIGS. 5–6. The carrier would utilize hydraulic rams or actuators to control and support the cutting head.

Figure 10:
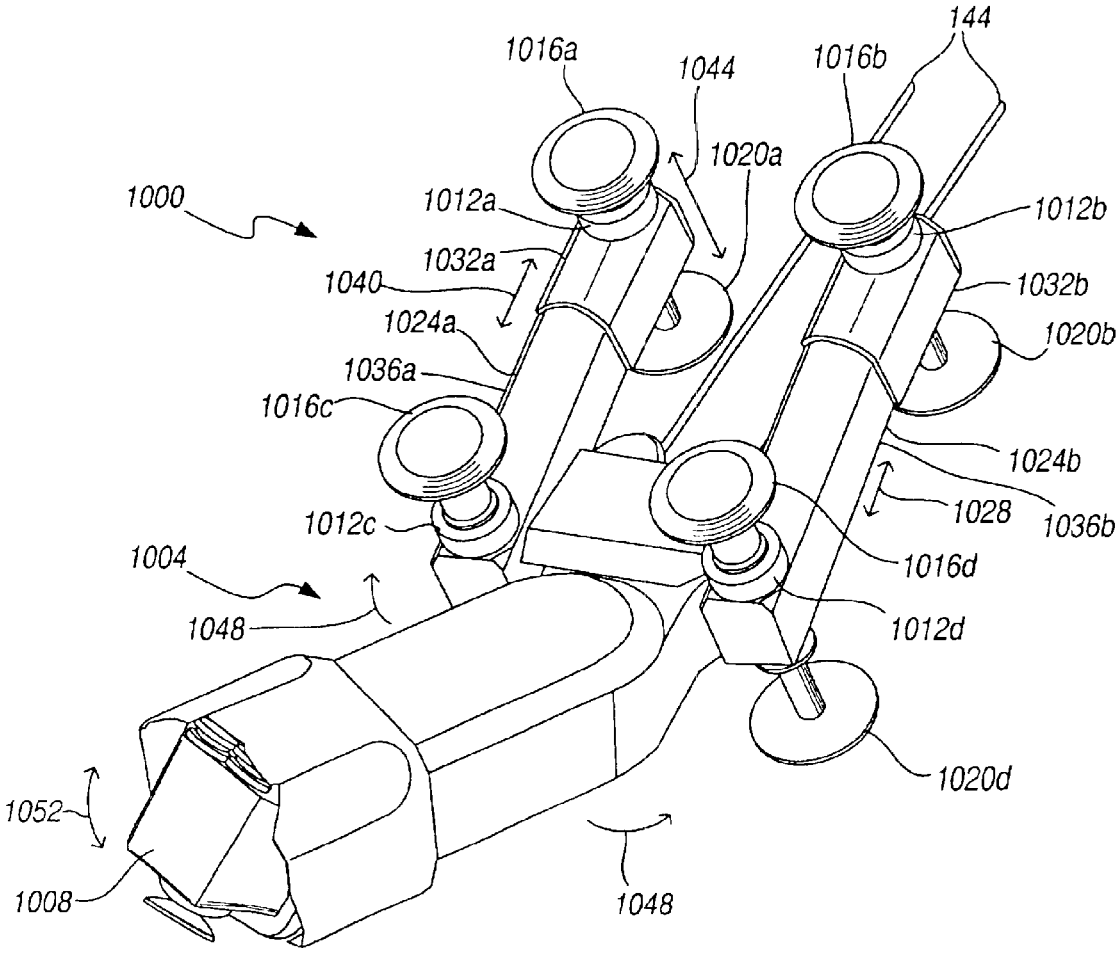
FIG. 10 is a perspective view of an excavator according to yet another configuration.

FIG. 10 depicts an excavator configuration that is particularly suited for vibrating undercutting disc cutters. The excavator includes a body 1000 and a boom 1004. The body 1000 includes a plurality of actuators 1012*a–d* and a corresponding plurality of hanging wall-engaging feet 1016*a–d* and footwall-engaging feet 1020*a–d*. The boom rotates side-to-side and engages a rotatably mounted cutting module 1008 engaging a cutter.

The excavator can have at least four degrees of movement. The forward section 1028 of the body 1000 has legs 1036*a,b* telescopically engaging the rear sections 1032*a,b* of the body. The legs are offset spatially from one another and have longitudinal centerlines (not shown) that are at least substantially parallel to one another. A hydraulic cylinder mounted longitudinally in each of the legs 1036*a,b* of the forward section 1028 causes the rear sections 1032*a,b* to move linearly forwards and backwards in the directions 1040. The rear sections can be moved independently of one another. The body 1000 can be moved upwardly and downwardly in the direction 1044 by differentially displacing or extending the hanging wall-engaging and footwall-engaging feet. The boom 1004, as noted, rotates side-to-side in the direction 1048. The cutting module 1008 rotates up and down in the direction 1052. As will be appreciated, the planes containing directions 1048 and 1052 are at least substantially orthogonal or perpendicular to one another. The plane containing direction 1048 is at least substantially parallel to direction 1040 while the plane containing direction 1052 is at least substantially parallel to direction 1044.

The excavator of FIG. 10 is able, through the (differential) extension of rear sections 1032*a,b* along legs 1036 and the orthogonal rotation of the boom and cutting module, to cut a slot of variable widths. As will be appreciated, the rear sections can be extended to differing lengths or positions along the legs. This can be highly advantageous in orebodies of variable widths to realize a lower degree of dilution.

Figure 11:
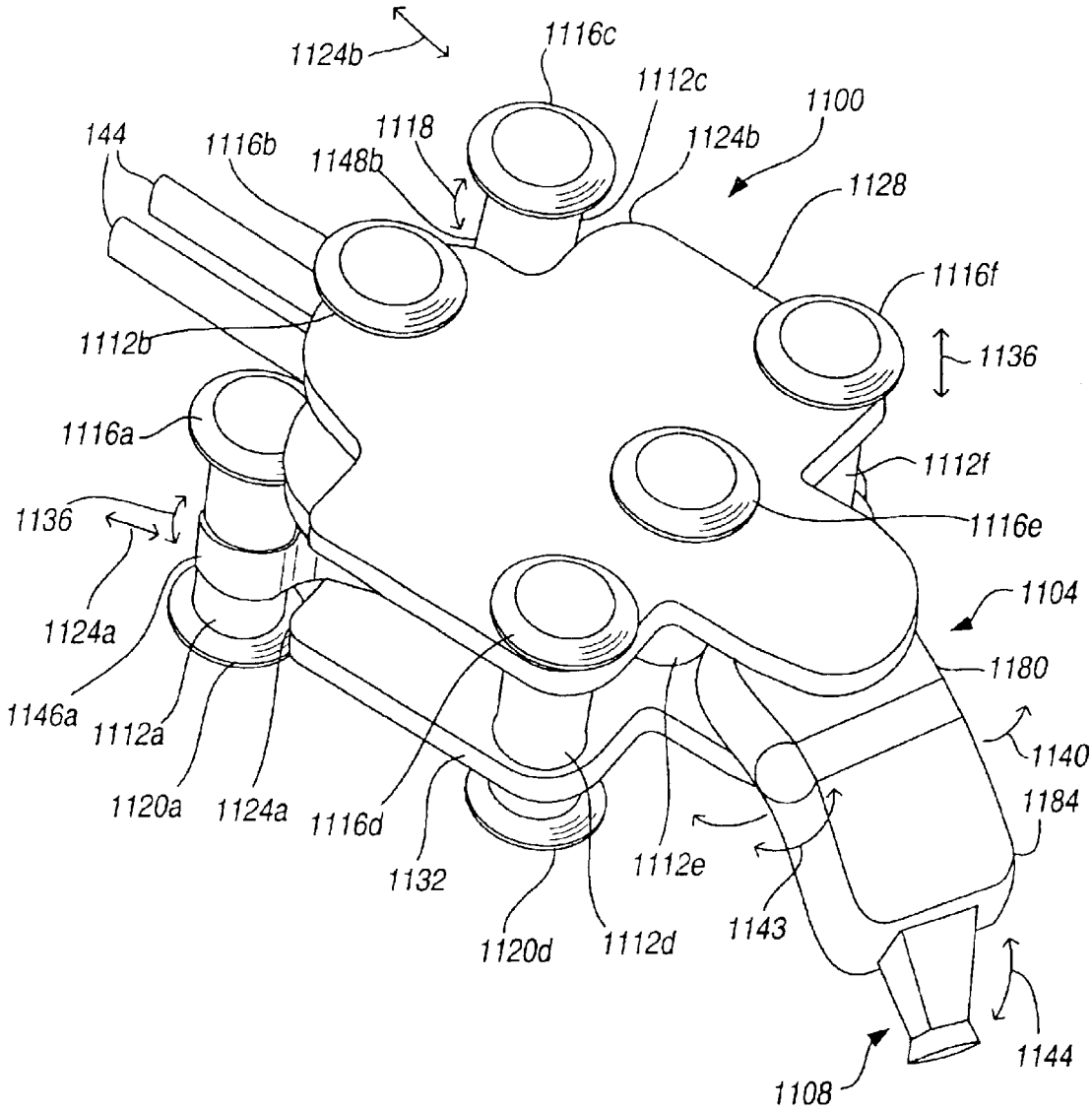
FIG. 11 is a perspective view of an excavator according to yet another configuration.

FIG. 11 depicts another excavator configuration that is particularly useful for vibrating undercutting disc cutters. The excavator includes a body 1100 and boom 1104. The body 1100 includes a plurality of actuators 1112*a–f*, each engaging a corresponding hanging wall-engaging foot 1116*a–f* and footwall-engaging foot 1120*a–f*. Differential displacement of the feet permits the body to move in the vertical direction 1136. The boom 1104 is articulated and includes first and second sections 1180 and 1184. The first section 1180 rotatably engages the second section 1184. The second section 1184 further includes a cutting module 1108 rotatably mounted thereon. The boom 1104 rotates side-to-side in the direction 1140, and the second section 1184 upwardly and downwardly in orthogonal direction 1143. The cutting module 1108 rotates upwardly and downwardly in direction 1144, which is in a plane at least substantially parallel to the plane of direction 1143 and at least substantially orthogonal to the plane of direction 1140. The rear actuators 1112*a* and 1112*c* are used to grip the hanging and footwalls while the other actuators are retracted to advance or retreat the body 1100. These two actuators are mounted at the end of arms 1148*a,b*, which rotatably or pivotably engage the upper and lower plates 1128 and 1132 of the body. The arms rotate respectively in the directions 1136 and 1118. A hydraulic actuator (not shown) mounted in or on each arm causes linear displacement of a rear portion of each arm in the direction 1124*a,b*, as shown. As the rear portions of the arms are extended and the body moved forward or retracted and the body moved rearward a respective angle between the centerline of each arm (not shown) and the centerline of the upper and lower plates 1128 and 1132 (or the body) (not shown) changes. As each arm is extended, the corresponding angle decreases in magnitude and, as each arm is retracted, the corresponding angle increases in magnitude due to rotation of the arm in the corresponding directions 1118 and 1136.

Blasting Techniques

The excavator 152 can also be implemented using drill-and-blast technology. The excavator 152 can use, for example, either small charge blasting in a shallow hole or large charge blasting in a deep hole, either of which can use stemming to increase blasting efficiency.

The drilling system preferably controls booms and feeds of drills in an automatic or semi-automatic manner, which will facilitate a remotely operated drilling system. The drilling system preferably is able to drill a set pattern thus providing a means of ensuring hole spacings and burdens are optimized as well as ensuring accurate wall control drilling. Automated drilling systems can optimize feed rates and minimize the potential for bogging the drill steels with little or no operator input.

Although any explosive charging system can be used, remote explosive charging systems, such as RocMec2000™ by DynoNobel are preferred.

Although any firing technique can be used, remote firing of the hole is preferred. Such systems are currently under development by Orica and DynoNobel.

The excavator 152 can include either a caterpillar or ram style carrier because it would only require sufficient feed force at the face to ensure that the drill steel remains secure while drilling. Although the excavator using this technique can be smaller than the above excavators, the excavator using this technique will require a relatively large inbuilt magazine to store the explosives.

The system can be designed as a relatively continuous method by using a carousel approach for the drill/charge cycle. Additionally, a series of carousels could be strung together to form a train, with each of the carriages operating independently on the drill, charge and blast cycle.

The umbilicals would provide water, electric power, hydraulic power, and telemetry.

An excavator using drill and blasting techniques can have considerable flexibility in its excavation width and will be relatively simple to steer. It will produce considerable dust and gaseous emissions, which will require considerable water to control. While this approach is likely the simplest approach, is well known to mine personnel, and has a great deal of flexibility by permitting the drill pattern to be changed to accommodate varying thicknesses of the orebody, it may be difficult to operate in a continuous mode.

Plasma-Hydraulic or Electric Pulse Discharge Techniques

The excavation can also be implemented using plasma hydraulic or electrical pulse discharge techniques. The plasma hydraulic technique is described in U.S. Pat. Nos. 6,215,734; 5,896,938; and 4,741,405, and U.S. Provisional Application Ser. No. 60/345,232 entitled "Method and Apparatus for a Plasma-Hydraulic Continuous Excavation System," filed Jan. 3, 2002, which are incorporated herein by this reference. The plasma-hydraulic technique works by creating an intense shock wave in water to crush rock. The shock wave is created by rapidly expanding plasma which in turn was created by an electric spark created in water and a high power pulse of electricity being passed through this spark. The shock waves are created by an electrode known as a projector, and an array of these projectors is used to excavate an area of rock. The umbilical 144 (FIG. 1) provides flushing water, electric power, and telemetry. As will be appreciated, the electrical power required by this technique is typically much greater than the electrical power required by the other techniques. The carriage for a plasma hydraulic system can be any suitable carriage, including those discussed above.

The plasma-hydraulic technology is theoretically well suited to the mining technique of the present invention in that it is scalable, produces fine fragmentation, and is a continuous mining process. The ore slurry produced by this technique makes the technique conducive to cost effective hydraulic hoisting and will allow considerable savings in mill comminution.

Although only a few types of excavators have been discussed above, it is to be appreciated that any suitable excavation system can be employed depending on the application. Examples of other techniques include water jets, impact hammers, impact rippers, and pick cutters.

Operation of the Mining Method

Referring to FIGS. 1–3, the operational steps of the mining method will now be described. As shown in FIG. 1, the excavation system 124 excavates material in the orebody 100 in a series of parallel slices 172*a–h*. The deployment system 120 is positioned in the first tunnel 108 above the excavation system 124 and progressively lowers the excavation system 124 as the excavator 152 excavates material. The excavated material 132 falls under the combined influence of gravity and water (which assists in cooling, clearing cuttings and dust suppression) to the second tunnel 112 where the excavated material 132 is collected by a suitable haulage system, such as the loader 128, and removed from the second tunnel 112. The loader 128 operates under the unexcavated section of the orebody 100 and is thereby protected from the falling excavated material. Alternatively, the loader can operate under previously excavated slices (on the other side of the muck pile 132) at a safe distance from the excavator 152 and the falling material 190.

When the excavation system 124 completes the excavation of slice 172*a* or is located at or adjacent to the second tunnel 112, the deployment system 120 raises the excavation system 124 to the first tunnel 108 and moves to a new position behind the current position to prepare for excavation of the next slice 172*b*. In the new deployment system position, the excavation system 124 is positioned above the next slice 172*b*. When in the first tunnel 112, the excavation system 124 starts a new cut, such as by engaging head and feet against the hanging wall and footwall (both being in the plane of the page), respectively.

As desired, support for the hanging and footwalls can be provided by any technique, such as by leaving a slice or a portion thereof in position to act as a pillar, timbering, forming concrete, cement, or grout pillars, backfilling, steel sets, waste rock, and intrusive ground support techniques such as cables, gewie bars, resin bolts, split sets, grouted dowels, swellex bolts, etc.

Automated Excavation System for Mining Method

The mining method described above can be used with a manned or fully or partly automated excavation system. Due to the relative inaccessibility of the excavator, a fully or partly automated excavation system is preferred. An embodiment of an automated excavation system will now be discussed.

Figure 12:
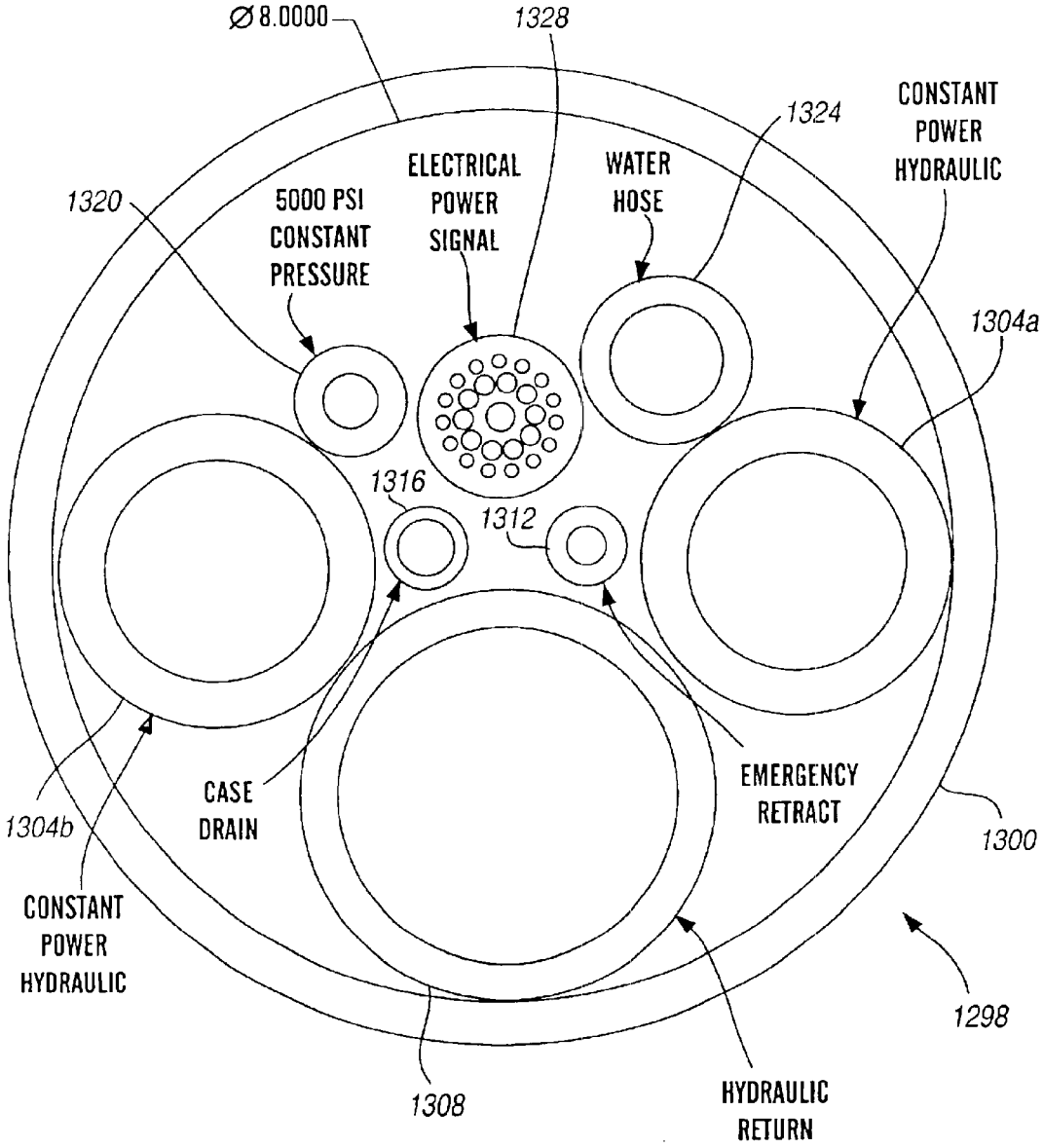
FIG. 12 is a cross-sectional view of an umbilical for the excavator of FIG. 5.

FIG. 12 depicts an umbilical 1298 that is particularly useful for the excavator of FIG. 5 above. The umbilical 1298 comprises a sheath hose 1300 (which may contain a strengthening component such as woven or braided steel fibers), constant power hydraulic lines 1304*a,b*, a hydraulic return line 1308, a emergency hydraulic retract line 1312, a hydraulic fluid case drain line 1316, a constant pressure hydraulic fluid line 1320, a water hose 1324, and a plurality of electrical power/signal conductors 1328.

Figure 4:
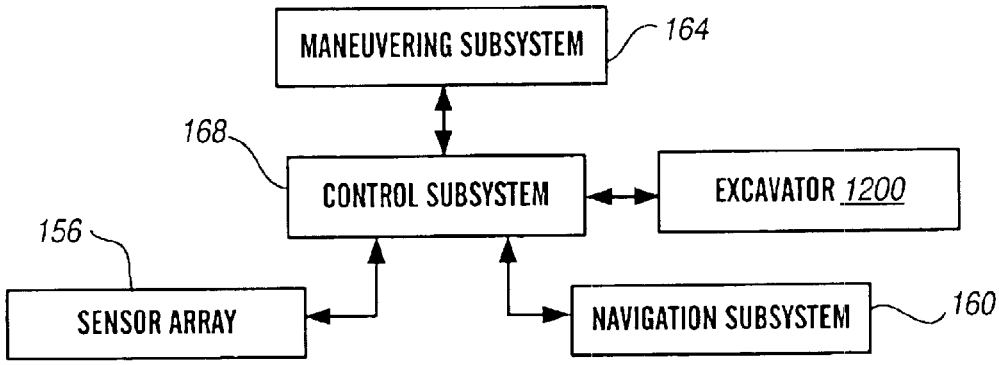
FIG. 4 is a block diagram of the various system components of an embodiment of an excavator system according to an embodiment of the present invention.

The automated excavation system includes a number of subsystems. Referring to FIG. 4, the system includes not only the excavator 1200 to excavate the orebody 100 but also a sensor array 156 to assist in positioning the excavator 1200, a navigation subsystem 160 to track the position of the excavator 1200, a maneuvering subsystem 164 to maneuver the excavator 1200, and a control subsystem 168 to receive input from sensor array 156 and the navigation subsystem 160 and provide appropriate instructions to the maneuvering subsystem 164, excavator 1200, sensor array 156, and/or navigation subsystem 160.

The sensor array 156 and navigation subsystem 160 are important to the effectiveness of the excavator system 124. As will be appreciated, location errors can result in increased dilution and a reduced economic outcome. The systems are capable collectively of defining the position of the excavation system 124, whether the excavation system's position is relative to a known 3D model (such as the digital map or model discussed below) or to a real time and/or previously sensed vein or structure. The subsystems are preferably at least partially integrated, operate in a complementary manner, and are typically distributed systems, with some components being on the excavator and other components being on the deployment system 120.

The sensor array 156 includes an assortment of geophysical sensors, position sensors, attitude sensors, and component monitoring sensors. The desired combination of sensors depends on the rock properties, orebody geometry, and access configuration. Examples of such sensors 156 include inertial sensors, attitude (or pitch/roll) sensors (such as inclinometers), tilt sensors, gyros, accelerometers, etc.), magnetic sensors, laser gyro sensors, sound monitors, laser positioning sensors, video cameras (e.g., conventional, infra-red, and/or ultraviolet), vibration sensors, directional gamma radiation sensors, electrical discharge detectors, distributed (on board) geophysical instruments, navigation sensors, cavity monitoring sensors, cylinder position and force sensors (such as temposonics, pressure transducers, load cells, and rotary sensors), hydraulic fluid pressure sensors, end-of-stroke sensors to monitor boom position, temperature sensors, fluid level sensors, boom position sensors, cutter wear sensors, chemical sensors, x-ray sensors, laser tracking sensors, and seismo-electric sensors. It is believed that the highest resolution of orebody geometry will be provided by geophysical sensors using the seismic and radar reflection methods, particularly if parallel access to the vein is possible. Other geophysical sensor technologies that may also be effective include radio imaging and optical techniques.

The navigation subsystem 160 provides the real-time capability for defining position with respect to a fixed 3D reference (e.g., in geographical coordinates) and/or a geologic feature and following a prescribed trajectory or path. The navigation subsystem 160 preferably provides in real time the position and/or attitude of the excavator 152. The navigation subsystem 160 can include position determining components, such as a geopositioning system, a video camera, one or more electromagnetic transmitters and receivers and triangulation logic, laser range meters, inertial navigation sensors, operator positional input, and systems for measuring the distance traveled by the excavator from a fixed reference point; a digitally accessed coordinate system such as the static or continuously or semi-continuously updated digital map or model of the orebody 100; and one or more navigation computational components. The digital map is typically generated by known techniques based on one or more of an orebody survey (performed using diamond core drilling logs, surrounding geologic patterns or trends, previously excavated material, chip samples, and the like). The map typically includes geophysical features, such as target orebody location and rock types (or geologic formations), and excavation features, such as face location, tunnel locations, shaft locations, raise and stope locations, and the like. The map can be updated continuously or semi-continuously using real time geophysical, analytical and/or visual sensing techniques. Examples of digital mapping algorithms that may be used include DATAMINE™ sold by Mineral Industries Computing Ltd. and VULCAN™ sold by Maptek. The navigation computational components can include any of a number of existing off-the-shelf integrated inertial navigation systems, such as the ORE RECOVERY AND TUNNELING AID™ sold by Honeywell, the Kearfott Sea Nav system, and the Novatel BDS Series system.

The maneuvering subsystem 164 can be any positioning system for the excavator 152 that preferably is remotely operable. The maneuvering subsystem 164 should be a secure and robust carrier which can steer (tightly) through cutting action in three dimensions and adapt to varying stope widths. Illustrative methods of implementing these capabilities include hydraulic (or pneumatic) rams, rotational mounts and extendable arms to enable the excavator to walk, articulated arms capable of allowing the excavator to work in various vein widths and pitches, extendible (or expandable) caterpillar style tracks to maintain contact with the hanging and footwalls, and combinations of these techniques. Typically and as shown by the excavator of FIG. 5, the subsystem 164 includes a plurality of hydraulically activated actuators that exert pressure against surrounding rock surfaces to hold the excavator in position and provide suitable forces to exert against cutting device(s) in the excavator.

The control subsystem 168 typically includes a real time operating system such as QNX™ sold by QNX Software Systems Ltd. or Vxworks from Wind River, a control engine such as SIMULINK REAL TIME WORKSHOP™ sold by The Mathworks Inc. or ACE from International Submarine Engineering, to provide suitable control signals to the appropriate components, and application software that can receive information from the sensor array, maneuvering subsystem, navigation subsystem, excavator, and/or operator and convert the information into usable input for the control engine.

A number of variations and modifications of the invention can be used. It would be possible to provide for some features of the invention without providing others.

Figure 8:
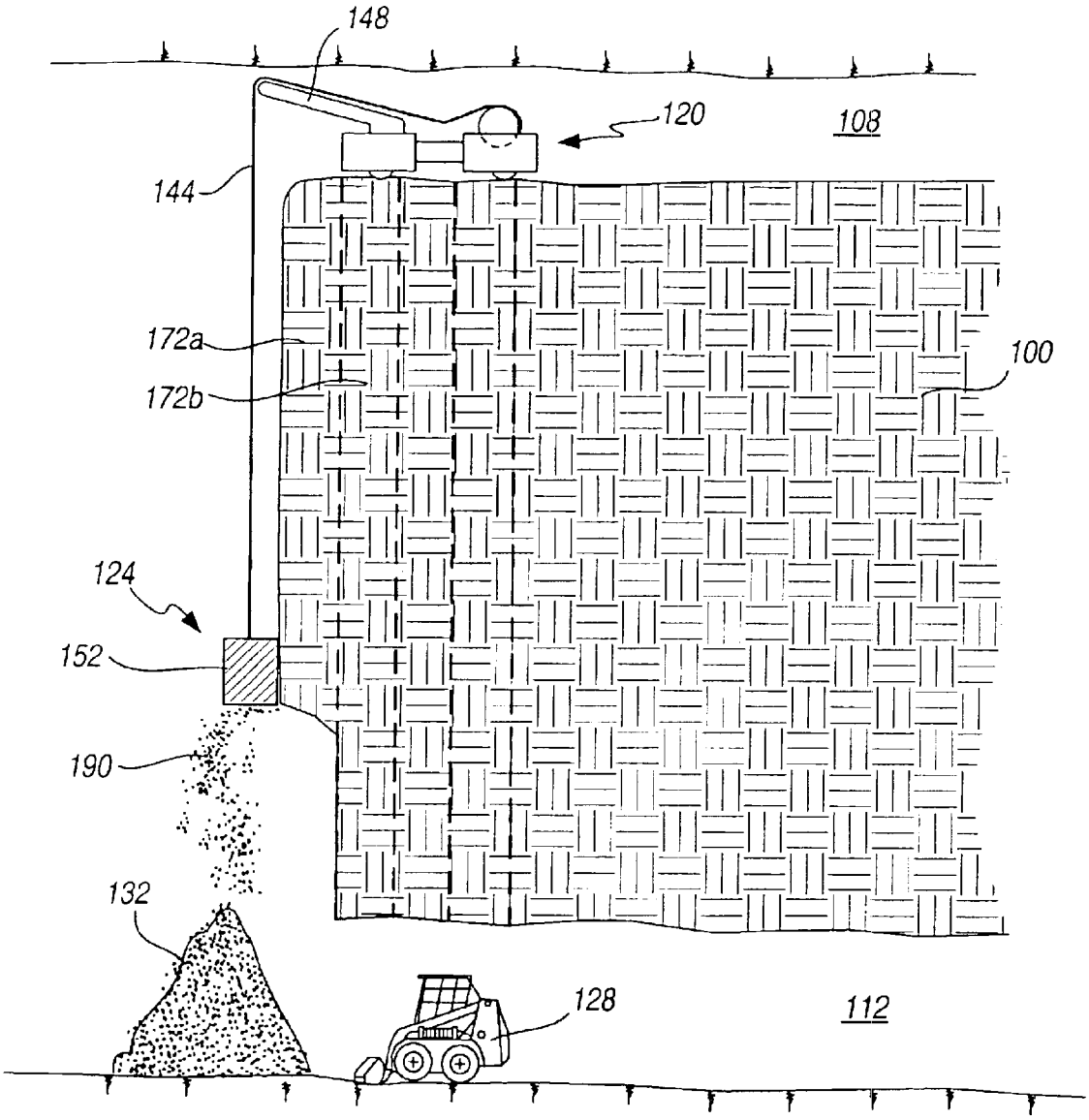
FIG. 8 is a side view of another embodiment of a mining method according to the present invention.

For example in one alternative embodiment, the excavation system 124 is positioned beside or next to the face 194 and excavates the material from the side as shown in FIG. 8. This embodiment is particularly useful for drill and blasting techniques. The holes are drilled perpendicular to the face 194. The excavation system 124 can be raised to avoid damage thereto when the explosives in the holes are initiated.

Figure 9:
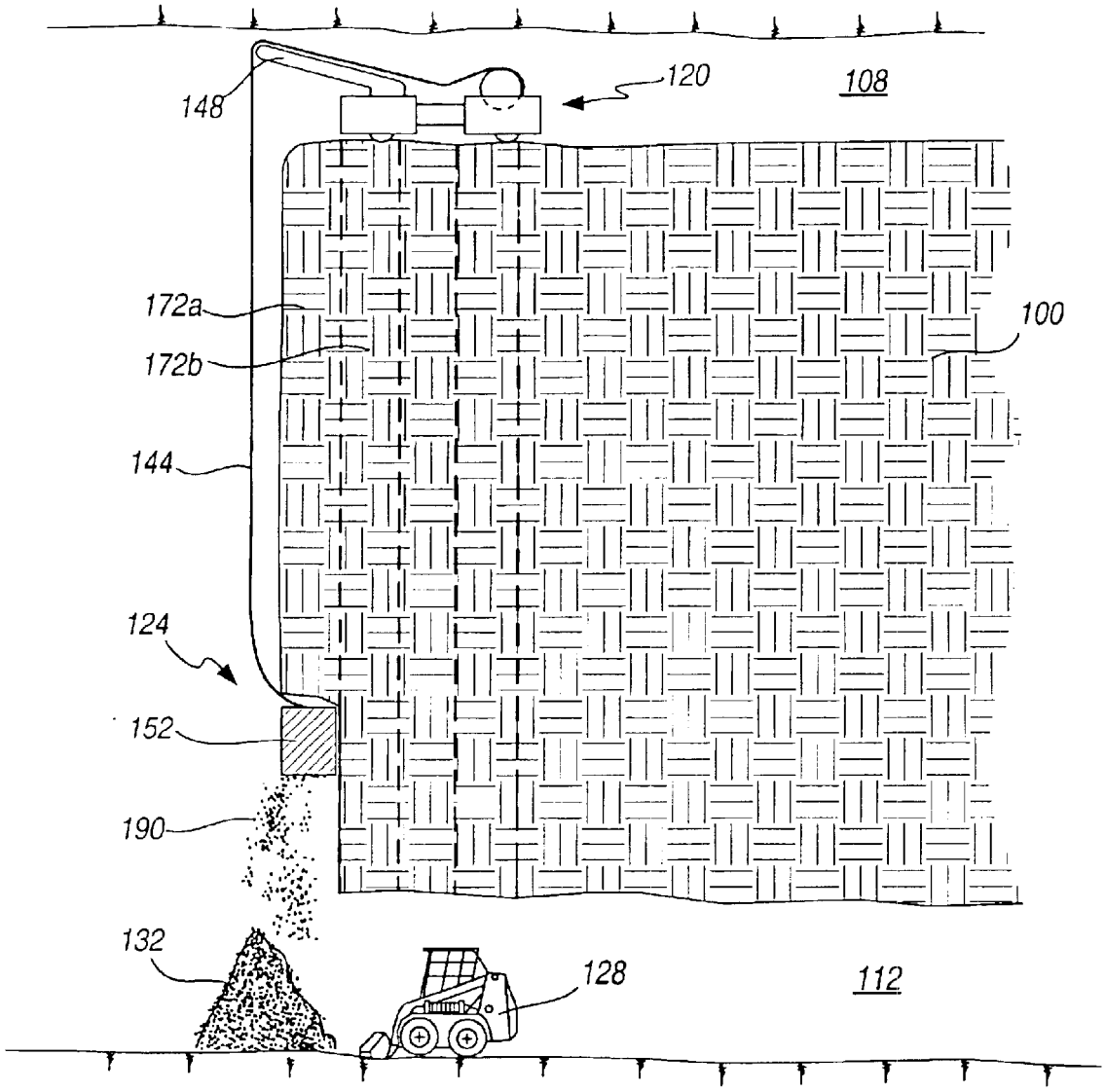
FIG. 9 is a side view of yet another embodiment of a mining method according to the present invention.

In another alternative embodiment, the material in each slice is excavated from the bottom/up (or up-dip) rather than from the top/down (or down-dip as shown in FIG. 1). This embodiment is shown in FIGS. 8–9. Common reference numbers refer to the same components. The embodiment in FIG. 8 is used typically for drill and blasting techniques while the embodiment in FIG. 9 is used typically for other types of excavators. In either case, the deployment system 120 lowers the excavation system 124 to a position at or adjacent to the second tunnel 112 at the initiation of the excavation of a slice 172. The excavation system 124 will be located at or adjacent to the first tunnel 108 at the end of excavating slice 172*a*. The deployment system 120 then moves to a new position and lowers the excavation system 124 to a position at or near the second tunnel 112 to initiate excavation of the next slice 172*b*. As can be seen in FIG. 9, the excavator is located in the path of the falling excavated material, which can be problematical in certain applications. The excavation system typically must be able to reliably support itself between the hanging and footwalls as the cables 144 can provide only limited support for the excavation system 124 when the excavation system is excavating. If the excavation system loses its footing against the hanging and footwalls, the cables will, of course, suspend the excavation system 124 and keep the excavation system 124 from falling to the second tunnel 112. However, there is a danger that the moment of the swinging excavation system 124 about the boom 148 may cause damage to or dislodgement of the deployment system 120.

In yet another embodiment, the down-dip and up-dip methods can be combined. In this embodiment, the excavator 152 excavates down dip from the first tunnel 108 to the second tunnel 112 and then up dip from the second tunnel 112 to the first tunnel 108, where the cycle is repeated.

In yet another embodiment, the navigation system is used with only limited remote sensing. An accurately defined vein model or map allows the excavator system 124 to mine the orebody 100 without real-time ore sensing (remote sensing). However, the map must be accurate. An unreliable model or map will require real time assaying or, at least, realtime differentiation between the orebody 100 and surrounding (waste) rock, which can only be provided by remote sensing.

In yet another alternative embodiment, one or more of the umbilicals can include strength members to replace the cables.

In yet another alternative embodiment, an umbilical for hydraulic fluid can be omitted by using an on board tank and pump for the hydraulic fluid.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method for mining a valuable material in a steeply dipping deposit, comprising:

(a) in a deposit of a material to be excavated, the deposit having a dip of at least about 35° and a plurality of intersecting excavations, the plurality of intersecting excavations including at least first and second spaced apart excavations extending at least substantially in a direction of a strike of the deposit and at least a third excavation intersecting the first and second excavations and extending at least substantially in a direction of the dip of the deposit, the first, second, and third excavations defining a block of the deposit, deploying an articulated excavator in the third excavation, the articulated excavator comprising a rotating boom, at least one excavating device positioned on an end of the rotating boom, and a plurality of actuators positioned on the excavator, the plurality of actuators engaging the hanging wall and footwall of the third excavation to maneuver the excavator into a desired position and orientation relative to the block, wherein the articulated excavator is deployed in the third excavation using a mobile deployment system positioned in the first excavation;

(b) remotely transmitting electronic commands to the articulated excavator to control the position and orientation of the articulated excavator;

(c) the articulated excavator removing a first segment of the block, the first segment extending at least substantially the length of a side of the block and being adjacent to and accessible by the third excavation; and (d) the articulated excavator thereafter removing a second segment of the block, the second segment extending at least substantially the length of the side of the block and being adjacent to the first segment before the removing step (c).

2. The method of claim 1, wherein the deposit is a hard rock deposit of igneous or metamorphic origin and wherein, the mobile deployment system is operatively engaged with the excavator during steps (c) and (d).

3. The method of claim 1, wherein the deposit is not of sedimentary origin.

4. The method of claim 1, wherein the first and second segments are removed by the articulated excavator while the excavator is movably suspended in the third excavation.

5. The method of claim 1, wherein the first excavation is located at a shallower depth than the second excavation and wherein removing step (c) comprises:

positioning the articulated excavator at a first location near the first excavation;

moving the excavator progressively downwards while the excavator removes progressively the first segment;

when the excavator reaches a second location near the second excavation, repositioning the excavator at or near the first location; and moving the excavator progressively downwards while the excavator removes progressively the second segment.

6. The method of claim 5, wherein the excavated material moves under the force of gravity to a drawpoint located at or near the second excavation.

7. The method of claim 5, wherein, after the excavator reaches the second location, the method includes repositioning the mobile deployment system operationally engaged with the excavator by at least one flexible support member, wherein the mobile deployment system is a mobile winch, and wherein the at least one flexible support member is attached to the excavator during steps (c) and (d).

8. A method for excavating a material, including:

(a) providing first and second excavations, at least a portion of the first excavation having a bearing generally in the direction of a dip of a hard rock deposit, the second excavation passing through the deposit, wherein the deposit has a dip of at least about 25°, and wherein the first excavation is positioned transverse to the second excavation;

(b) deploying an articulated excavator in the second excavation, the articulated excavator comprising a rotating boom, at least one excavating device positioned on an end of the rotating boom, and a plurality of actuators positioned on the excavator, the plurality of actuators engaging the hanging wall and footwall of the second excavation to maneuver the excavator into a desired position and orientation relative to an exposed face of the deposit, wherein the articulated excavator is deployed in the second excavation using a mobile deployment system positioned in the first excavation;

(c) remotely transmitting electronic commands to the articulated excavator to control the position and orientation of the articulated excavator;

(d) in a first pass, moving the excavator in the second excavation along a first exposed portion of the deposit exposed by the second excavation to remove a first portion of the material in the deposit; and (e) in a second, later, pass, moving the excavator in the second excavation along a second exposed portion to remove a second portion of the material, wherein the first and second exposed portions were adjacent to one another.

9. The method of claim 8, further including:

(f) at the end of the first pass, moving a mobile positioning device engaged with the excavator to reposition the excavator for the second pass; and (g) raising the excavator to a starting position on the second exposed portion to begin the second pass.

10. The method of claim 8, further including:

(f) collecting excavated material at a position below first and second exposed portions; and (g) transporting the collected excavated material to a location for processing.

11. The method of claim 8, wherein the excavator comprises at least one of one or more disc cutters, water jets, impact hammers, impact rippers, and pick cutters, a blasting system, and an electrical pulse discharge system and combinations thereof.

12. The method of claim 8, wherein the second excavation is a shaft and wherein the excavator is at least partly suspended in the shaft by an elongated flexible member and is connected to a power source by an umbilical line and wherein the elongated flexible member is attached to the mobile deployment system and the excavator during steps (d) and (e).

13. The method of claim 8, wherein the excavator includes a remote sensing system that detects the presence of material in the deposit and a navigation system that determines a position of the excavator.

14. The method of claim 13, wherein the remote sensing system is at least one of a sound monitor, a vibration monitor, a directional natural gamma detector, a camera, on-board geophysics, electrical discharge analyzer, chemical sensor, and seismo-electric sensor.

15. The method of claim 12, wherein the umbilical line comprises at least one of a conduit to supply water for cooling and flushing rock cuttings, hydraulics for maneuvering the excavator, signal conductors for conveying control signals from a remote operator to the excavator, and electrical conductors for supplying power to the excavator and wherein the umbilical is connected to the excavator during steps (d) and (e).

16. The method of claim 8, wherein the excavator includes a winch to raise and lower itself in the second excavation.

17. The method of claim 8, wherein the excavator includes at least one of hydraulic rams, pneumatic rams, rotational mounts and extendable arms, and tracks for multidimensional movement in the shaft.

18. The method of claim 1, further comprising:

(e) providing hydraulic fluid to the articulated excavator using an umbilical extending from the first excavation to the articulated excavator.

19. The method of claim 18, wherein the umbilical further provides to the excavator at least one of electric power, water, and the electronic commands.

20. The method of claim 18, wherein the umbilical comprises a constant power hydraulic line, a hydraulic return line, an emergency hydraulic retract line, a hydraulic fluid case drain line, and a constant pressure hydraulic fluid line.

21. The method of claim 1, wherein the boom is extendable and retractable along a boom longitudinal axis and further comprising during removal of the second segment:

(e) determining whether the boom has a desired maximum degree of boom extension;

(f) when the boom has reached a desired maximum degree of boom extension, performing the substeps of:

(i) engaging actuators on the boom with the hanging wall of the third excavation;

(ii) disengaging actuators on the body from the hanging wall of the third excavation; and (iii) retracting the boom to decrease the distance separating the body from the at least one excavating device;

(iv) engaging the actuators on the body with the hanging wall; and (v) disengaging the actuators on the boom from the hanging wall;

(g) when the boom has not reached a desired degree of boom extension, further extending the boom; and (h) thereafter rotating the boom to remove additional material in the second segment.

22. The method of claim 21, wherein the boom has a desired maximum degree of boom extension and further comprising, before substep (i), the substeps of:

(vi) rotating the boom relative to the body to position the longitudinal axis of the boom transversely to the longitudinal axis of the body; and, after substep (iii) and before substep (iv): and (vii) rotating the body relative to the boom to position the longitudinal axis of the boom in substantial alignment with the longitudinal axis of the body.

23. The method of claim 1, wherein the excavator has at least four degrees of movement.

24. The method of claim 1, wherein the excavator comprises a sensor array to assist in positioning the excavator, a navigation system to determine a current position of the excavator relative to a selected coordinate system, and a control system to receive input from the sensor array and navigation system and provide instructions responsive thereto to the excavator actuators and boom hydraulics.

25. The method of claim 24, wherein the sensor array comprises a geophysical sensor, excavator position sensors, excavator attitude sensors, and excavator component monitoring sensors.

26. The method of claim 25, wherein the attitude sensors determine the pitch and roll of the excavator and the component monitoring sensors comprise a plurality of a vibration sensor, electrical discharge sensor, cavity monitoring sensor, cylinder position sensor, cylinder force sensor, hydraulic fluid pressure sensor, end-of-stroke sensor, temperature sensor, fluid level sensor, boom position sensor, and excavation device wear sensor.

27. The method of claim 24, wherein the navigation system determines a current position of the excavator relative to a fixed three-dimensional reference and/or a geologic feature and following a prescribed trajectory or path.

28. The method of claim 24, wherein the navigation system determines a current position of the excavator relative to a digital map of the deposit.

29. The method of claim 8, further comprising:

(f) providing hydraulic fluid to the articulated excavator using an umbilical extending from the first excavation to the articulated excavator.

30. The method of claim 29, wherein the umbilical further provides to the excavator at least one of electric power, water, and the electronic commands.

31. The method of claim 29, wherein the umbilical comprises a constant power hydraulic line, a hydraulic return line, an emergency hydraulic retract line, a hydraulic fluid case drain line, and a constant pressure hydraulic fluid line.

32. The method of claim 8, wherein the boom is extendable and retractable along a longitudinal axis of the boom and further comprising during removal of the second segment:

(f) determining whether the boom has a desired maximum degree of boom extension;

(g) when the boom has reached a desired maximum degree of boom extension, performing the substeps of:

(i) engaging actuators on the boom with the hanging wall of the third excavation;

(ii) disengaging actuators on the body from the hanging wall of the third excavation; and (iii) retracting the boom to decrease the distance separating the body from the at least one excavating device;

(iv) engaging the actuators on the body with the hanging wall; and (v) disengaging the actuators on the boom from the hanging wall;

(h) when the boom has not reached a desired degree of boom extension, further extending the boom; and (i) thereafter rotating the boom to remove additional material in the second segment.

33. The method of claim 32, wherein the boom has a desired maximum degree of boom extension and further comprising, before substep (i), the substeps of:

(vi) rotating the boom relative to the body to position the longitudinal axis of the boom transversely to the longitudinal axis of the body; and (vii) after substep (iii) and before substep (iv), rotating the body relative to the boom to position the longitudinal axis of the boom in substantial alignment with the longitudinal axis of the body.

34. The method of claim 8, wherein the excavator has at least four degrees of movement.

35. The method of claim 8, wherein the excavator comprises a sensor array to assist in positioning the excavator, a navigation system to determine a current position of the excavator relative to a selected coordinate system, and a control system to receive input from the sensor array and navigation system and provide instructions responsive thereto to the excavator actuators and boom hydraulics.

36. The method of claim 35, wherein the sensor array comprises a geophysical sensor, excavator position sensors, excavator attitude sensors, and excavator component monitonng sensors.

37. The method of claim 36, wherein the attitude sensors determine the pitch and roll of the excavator and the component monitoring sensors comprise a plurality of a vibration sensor, electrical discharge sensor, cavity monitoring sensor, cylinder position sensor, cylinder force sensor, hydraulic fluid pressure sensor, end-of-stroke sensor, temperature sensor, fluid level sensor, boom position sensor, and excavation device wear sensor.

38. The method of claim 35, wherein the navigation system determines a current position of the excavator relative to a fixed three-dimensional reference and/or a geologic feature and following a prescribed trajectory or path.

39. The method of claim 35, wherein the navigation system determines a current position of the excavator relative to a digital map of the deposit.

* * * * *